US009986863B2

(12) United States Patent
Datema

(10) Patent No.: US 9,986,863 B2
(45) Date of Patent: Jun. 5, 2018

(54) FLOOR CONSTRUCTION WITH VARIABLE GRADE OF RESILIENCE

(75) Inventor: Cornelis Pauwel Datema, Best (NL)

(73) Assignee: Koninklijke Philips N.V., Eindhoven (NL)

( * ) Notice: Subject to any disclaimer, the term of this patent is extended or adjusted under 35 U.S.C. 154(b) by 2009 days.

(21) Appl. No.: 13/148,687

(22) PCT Filed: Feb. 8, 2010

(86) PCT No.: PCT/IB2010/050551

§ 371 (c)(1),
(2), (4) Date: Dec. 8, 2011

(87) PCT Pub. No.: WO2010/092519

PCT Pub. Date: Aug. 19, 2010

(65) Prior Publication Data

US 2012/0101635 A1 Apr. 26, 2012

(30) Foreign Application Priority Data

Feb. 13, 2009 (EP) ..... 09152811

(51) Int. Cl.
*A47G 27/00* (2006.01)
*A47G 27/02* (2006.01)
*E04F 15/02* (2006.01)

(52) U.S. Cl.
CPC ..... *A47G 27/0231* (2013.01); *E04F 15/02* (2013.01)

(58) Field of Classification Search
None
See application file for complete search history.

(56) References Cited

U.S. PATENT DOCUMENTS 2,597,800 A * 5/1952 Hussman ..... 248/565
3,710,526 A 1/1973 Parks
3,811,237 A * 5/1974 Bettinger ..... 52/126.6
3,872,525 A * 3/1975 Lea et al. ..... 5/671
(Continued)

FOREIGN PATENT DOCUMENTS

DE 3137757 C1 9/1981
DE 4012493 A1 4/1990
(Continued)

OTHER PUBLICATIONS

I-Brick Brickwork Help & Advice, Downloaded From http://www.home-building-answers.com/floor-construction.html on Dec. 5, 2014, 6 Pages.

(Continued)

*Primary Examiner* — Christopher E Everett

(57) ABSTRACT

The present invention is related to a floor construction. To provide a floor that is able to serve the different aspects of the use and the user himself, in particular to aspects related to longer standing periods, a floor construction is proposed that comprises a resilient layer (12) with a variable resilience and an adapting surface (14) and means for varying the grade of resilience. In one exemplary embodiment the resilient layer (12) comprises a cavity structure with a number of cavities (18). The cavities (18) are filled with a medium (20) with a variable flexibility. The medium (20) is enclosed in a number of containers 22 with a flexible, non-expandable envelope and the flexibility of the medium can be modified.

22 Claims, 5 Drawing Sheets

(56) References Cited

U.S. PATENT DOCUMENTS

| | | | | |
|---|---|---|---|---|
| 4,542,547 | A * | 9/1985 | Sato | 5/713 |
| 4,581,863 | A * | 4/1986 | Thaler | 52/126.2 |
| 4,846,457 | A * | 7/1989 | Vaux | 472/92 |
| 4,856,626 | A * | 8/1989 | Nakanishi | 188/371 |
| 4,942,703 | A * | 7/1990 | Nicolai | 52/167.7 |
| 5,109,784 | A | 5/1992 | Lepe-Cisneros | |
| 5,115,969 | A | 5/1992 | Tanaka et al. | |
| 5,542,221 | A * | 8/1996 | Streit et al. | 52/403.1 |
| 6,182,903 | B1 * | 2/2001 | Fiedrich | 237/69 |
| 6,520,491 | B2 * | 2/2003 | Timlick | 267/113 |
| 6,526,704 | B1 * | 3/2003 | Berard et al. | 52/177 |
| 6,584,745 | B1 * | 7/2003 | Johansson | 52/480 |
| 7,241,819 | B2 | 7/2007 | Bowe | |
| 7,575,796 | B2 * | 8/2009 | Scott et al. | 428/120 |
| 7,993,244 | B2 * | 8/2011 | Weller | 482/26 |
| 8,531,646 | B2 * | 9/2013 | Shi et al. | 349/202 |
| 2002/0160151 | A1 | 10/2002 | Pinault et al. | |
| 2002/0177508 | A1 * | 11/2002 | Eyman et al. | 482/23 |
| 2003/0009960 | A1 | 1/2003 | Aso | |
| 2003/0233801 | A1 | 12/2003 | Pace | |
| 2004/0010995 | A1 | 1/2004 | Pace | |
| 2004/0020142 | A1 | 2/2004 | Kress | |
| 2004/0049856 | A1 * | 3/2004 | Chae | 5/711 |
| 2004/0154240 | A1 | 8/2004 | Hiraguri et al. | |
| 2004/0250482 | A1 | 12/2004 | Jacobson et al. | |
| 2005/0072101 | A1 | 4/2005 | Nunokawa | |
| 2005/0188638 | A1 | 9/2005 | Pace | |
| 2005/0235590 | A1 | 10/2005 | Pace | |
| 2006/0014009 | A1 | 1/2006 | Weidner | |
| 2006/0026752 | A1 | 2/2006 | Torres | |
| 2006/0110617 | A1 | 5/2006 | Kitaike et al. | |
| 2006/0150574 | A1 | 7/2006 | Scoville et al. | |
| 2006/0153635 | A1 | 7/2006 | Underwood | |
| 2006/0230696 | A1 | 10/2006 | Sarkkinen | |
| 2006/0260233 | A1 | 11/2006 | Schluter | |
| 2007/0137139 | A1 | 6/2007 | Tierney et al. | |
| 2007/0173379 | A1 * | 7/2007 | Harinishi et al. | 482/23 |
| 2007/0175173 | A1 | 8/2007 | Babineau et al. | |
| 2007/0218260 | A1 | 9/2007 | Miclo et al. | |
| 2008/0060299 | A1 | 3/2008 | Dubey et al. | |
| 2008/0246177 | A1 | 10/2008 | Baus et al. | |
| 2008/0281472 | A1 * | 11/2008 | Podgorny et al. | 700/276 |
| 2009/0000778 | A1 * | 1/2009 | Nathan et al. | 165/202 |
| 2009/0026192 | A1 | 1/2009 | Fuhrman | |
| 2009/0064630 | A1 | 3/2009 | Torres | |
| 2009/0311932 | A1 | 12/2009 | Hughes | |
| 2009/0314848 | A1 | 12/2009 | Andersson | |
| 2010/0013255 | A1 | 1/2010 | Mantovani et al. | |
| 2010/0126110 | A1 | 5/2010 | Giles | |
| 2010/0192498 | A1 | 8/2010 | Gleckman | |
| 2010/0273019 | A1 | 10/2010 | Kitaike et al. | |
| 2011/0011020 | A1 | 1/2011 | Shen | |
| 2011/0132470 | A1 | 6/2011 | Schnyder et al. | |
| 2011/0268904 | A1 | 11/2011 | La Rocque | |
| 2011/0271638 | A1 | 11/2011 | Tierney et al. | |
| 2011/0290896 | A1 | 12/2011 | Jonsson | |
| 2012/0085886 | A1 | 4/2012 | Xie et al. | |
| 2012/0183014 | A1 | 7/2012 | Larsen et al. | |
| 2012/0198611 | A1 | 8/2012 | Zierler | |
| 2012/0240504 | A1 | 9/2012 | Miller | |
| 2012/0260594 | A1 | 10/2012 | Blackstock et al. | |
| 2012/0272600 | A1 | 11/2012 | Ytterberg | |
| 2012/0272608 | A1 | 11/2012 | Groenesteyn | |
| 2013/0043701 | A1 | 2/2013 | Hagenbuch | |
| 2013/0104488 | A1 | 5/2013 | Lepot | |
| 2013/0205982 | A1 | 8/2013 | Walter et al. | |
| 2013/0221744 | A1 | 8/2013 | Hall et al. | |
| 2013/0333550 | A1 | 12/2013 | Jacobsen | |
| 2014/0048008 | A1 | 2/2014 | Kalil | |
| 2014/0115976 | A1 | 5/2014 | Lippert | |
| 2014/0137494 | A1 | 5/2014 | Stahl, Jr. et al. | |
| 2014/0265555 | A1 | 9/2014 | Hall | |
| 2015/0121775 | A1 | 5/2015 | Lippert | |

FOREIGN PATENT DOCUMENTS

| | | | | |
|---|---|---|---|---|
| EP | 0835969 | A2 | 10/1997 | |
| GB | 2447287 | A | 9/2008 | |
| WO | WO/1996/028057 | * | 9/1996 | A43B 7/28 |

OTHER PUBLICATIONS

Home Building Answers Floor Contruction, Downlowded From http://www.i-brick.com/concrete-or-timber-floor/ on Dec. 5, 2014, 9 Pages.

* cited by examiner

FLOOR CONSTRUCTION WITH VARIABLE GRADE OF RESILIENCE

FIELD OF THE INVENTION

The present invention is related to a floor construction.

BACKGROUND OF THE INVENTION

Floor constructions are usually designed for a determined purpose. Hence, their characteristics, i.e. their different parameters, such as physical strength, softness, haptics or feel of the surface, aesthetic appearance etc, are set according to the determined purpose. Concerning the constructive characteristics, floor constructions are provided in a rather static manner. Simply said, a built floor construction usually rests in the same place with the same characteristics for a rather long term. A change of the floor construction and a change of the floor characteristics are only carried out in case of a change in the use of the floor construction or in case the floor surface is worn out or destroyed somehow that makes a replacement necessary. In any case, the floor construction is always subject to the use of the floor. The use of the floor is defined by the use of the room itself where the floor is located. This can be an interior space or an area outside of a building, e.g. an exterior space. Of course, a floor construction has to be suitable for the specific needs resulting from the determined use of a space where the floor is located. Hence, floor constructions are usually regarded as being a sort of sub-item only playing a secondary role compared to other building components such as, for example, the facade of a building.

SUMMARY OF THE INVENTION

It has been shown that in certain cases the floor parameters are regarded as being increasingly important for the user's comfort and the productivity of employees using the room. This is especially the case for rooms which are designed for such purposes where staff needs to stand for longer periods. In such rooms, for example, in craft shops or in surgery rooms or examination rooms in a hospital where operations are undertaken, floor constructions are designed such that they are suitable for being durable, for being easily cleanable, for placing heavy equipment on them and for being suitable for rollable equipment, such as material containers or hospital beds, just to mention a few aspects. But there may exist a need for a soft floor construction which can help to reduce lower back fatigue and pain. These aspects are getting increasingly important in the view of labour productivity and the costs connected herewith. To meet the needs, so-called anti-fatigue floor mats are provided. These mats are arranged in those areas where staff members need to stand for a longer period. But it has shown that these mats have disadvantages that lead to regular complaints. For example, they are not very easily cleanable and can be an obstacle for rolling equipment across them. For a larger floor area mats are added which can lead to ridges, for example. The present invention therefore aims at providing a floor construction that is able to serve the different aspects of the use of the room and the requirements by the user himself.

The object is reached with a floor construction according to the independent claims.

In a preferred embodiment a floor construction comprises a resilient layer with a variable resilience and an adapting surface and means for varying the grade of resilience.

The term resilience stands for the characteristics of the floor that are concerning both the actual feeling when standing or resting in some other way on the floor and the resistance the floor provides for load impacts acting on the floor, usually due to gravitation. For example, when standing on a concrete floor, the floor provides a feeling of hardness to the user, whereas, for example, a thick and fluffy carpet provides a feeling of softness. Of course, this feeling of the floor is also influenced by the user's footwear. Another aspect meant by the term resilience is flexibility. In a certain way this means the ability of the floor surface to change its shape, in other words to allow a sort of local de-forming where the load impact occurs, and to return to its original state once the load impact is relieved. The force to recover or to regain its shape is usually inherent in the material of the floor construction. Simply said, the floor's flexibility relies on a sort of "spring force", due to material characteristics. Resilience is also related to the damping effect of a floor. For example, a soft carpet is damping the impact forces when walking across the carpet, especially when wearing shows with hard soles such as leather, for example. But damping can also occur when the actual surface material is hard, such as a rather thin wooden layer on a damping layer, to name a simple example.

The floor construction, according to the invention, with a variable resilience, or simply said with an adjustable softness, has the advantage that it can fulfil different requirements concerning its resilience. For example, during a preparation phase in an operation room in a hospital, the floor construction will show a rather hard or stiff surface. On such a floor surface, movable components such as furniture, for example, hospital beds or wheelchairs, or other technical equipment such as a mobile examination apparatus, can easily be rolled across the surface. When the surface is rather stiff it is also possible to slide elements for a correct arrangement for the upcoming procedure. Once the preparation process is accomplished it is then possible to change the grade of resilience of the surface to a softer floor surface. Such a softer surface provides a better comfort for staff standing for a longer period which, for example, is the case for surgeons and assistants during an operation, especially when the operation is a more complex operation lasting for several hours. The softer surface of the floor can thus help to reduce lower back fatigue and pain and thus enhances the user's comfort.

In a preferred embodiment, the grade of resilience can be varied for certain parts of the floor. In other words, a floor area is provided with a floor construction comprising a variable resilience only in certain designated areas and not over its whole area.

For example, in a hospital room there will be a central area where the patient is located on supporting means, for example, an operating table or a bed, wherein this central area can be predetermined by provided lighting means on the ceiling of the room. The place where the staff members will stay for a longer period will then be approximately around this central area. Whereas the surrounding boundary areas, i.e. the areas next to the surrounding walls, will usually be occupied by technical equipment or storage means, in other words, the likelihood of staff members standing in these areas for longer periods is very low. Thus, a varying grade of resilience in these areas, i.e. in areas where it is not expected that staff members will stay for longer periods, is not necessary.

In a further preferred embodiment, a floor construction is provided where the grade of resilience can be varied independently for a number of parts of the floor area. Thereby it is possible to adapt the floor softness to different requirements. For example, it is thereby possible to provide a varied soft surface on one side of an operation table whereas the other side of the operation table is not so soft, for example, when the two operators standing on each side of the operation table have different requests concerning the resilience of the floor. Thus, by enhancing the possibilities to fulfil the user requirements, a floor construction is provided which serves for an optimised user comfort. Depending on the means for varying the grade of resilience it is, of course, possible to divide the floor area into rather small parts to be able to adapt the floor softness to the individual standing areas of the different staff members. As a further example, varying the grade of resilience can also be reasonable and valuable, for example, in a craft shop, where the work process requires concentration and alertness of staff members, for example, craftsmen, standing operating machines.

In a preferred embodiment the floor surface is a continuous layer to allow an easier cleaning and maintenance. For an easier identification of different resilience zones or part, these can be optically marked, for example by embedded symbols or lines.

In a further preferred embodiment, the resilient layer comprises an embedded cavity structure with at least one cavity, wherein the at least one cavity is filled with a medium with a variable flexibility and wherein means are provided for modifying the flexibility of said medium.

For example, the resilient layer comprises a sort of matrix or base material that serves as a supporting structure for the cavities. The variability of the grade of resilience is then fulfilled by the medium. To allow a varying grade of resilience, the resilient layer, i.e. the matrix material, for example, possesses a certain resilient characteristic itself. To increase the stiffness of the whole resilient layer, the flexibility of the medium is then modified to a less resilient medium characteristic, in other words, the medium is stiffened by the means provided for modifying the flexibility. When the stiffness of the resilient layer shall be decreased, in other words, when the floor should be softer, the flexibility of the medium is changed to a softer characteristic, thereby softening the support of the matrix material.

In a preferred embodiment, the embedded cavity structure is arranged in the upper part of the resilient layer.

By this it is possible to provide a resilient layer material, for example, a matrix material, that is rather stiff and acts as a supporting structure for the cavities which are located above. The cavity structure then serves as the resilient zone within the layer. The grade of resilience of this zone can then be varied by the means provided for modifying the flexibility of the medium which is located inside the cavities. A flooring material can then be provided on top of the adapting surface. Depending on the material of the resilient layer, the flooring material can be, for example, a coating or an additional layer with an additional flooring material sheet on top of the resilient layer.

Of course it is possible to provide several layers on top of the adapting surface to provide a floor surface to fulfil the current requirements. These several layers can, for example, consist of different coatings providing protection, for example, in a laboratory, depending on the use of the room. However, the additional layers to be placed on the adapting surface show a certain minimum degree of flexibility. This is, because a very stiff layer on top of the adapting surface would damp the resilience of the resilient layer and would thus prohibit a floor construction with a varying grade of resilience.

In a further exemplary embodiment, the cavity structure is arranged within the resilient layer such that the cavities extend from the lower margin of the resilient layer to the upper margin of the resilient layer.

The terms upper and lower are related to the arrangement of the floor in its implemented state, in other words, when the floor construction is installed in its final location.

The base material of the resilient layer is resilient to a certain degree to provide a soft floor surface. For a rather stiff floor surface, the medium inside the cavities extending across the whole thickness, or at least a substantial part of the floor thickness, will be provided with a medium with a flexibility modified to a stiff characteristic.

In a preferred embodiment, the medium with a variable flexibility is enclosed in at least one container with a flexible, non-expandable envelope.

Thus, the medium can be modified to be very flexible and the container, due to its flexibility itself, will not prevent a flexibility of the resilient layer. For a rather stiff floor surface the medium can be modified to be rather stiff itself. When a load pressure is then exerted on a part of the floor area the medium inside the container will distribute the load to other parts of the container volume. Because the container is non-expandable, an expanding of the container at another area is prevented, in other words, the non-expandable envelope prevents a buckling of the cavity structure.

In a further preferred embodiment, the medium comprises a material with a temperature dependent rigidity and means are provided to change the temperature of the medium.

The softness of the floor construction can then be varied by changing the temperature of the medium. For example, the floor construction can be heated similar to a floor heating which also can serve for providing a comfortable ambient temperature for the staff members using the floor construction. Thereby the floor construction will show a softer grade of resilience. In case a stiffer floor construction is required, for example, during a preparation phase, the resilient layer will then be cooled, or depending on the ambient temperature of the room, simply not heated, such that the temperature dependent rigidity material will be stiffer to provide the required stiffness of the floor surface.

In a preferred embodiment, the material with a temperature dependent rigidity is a gel and a floor heating and cooling device is provided.

Such a gel has the advantage that the temperatures where the medium is soft and the temperatures where the medium is rather stiff can be adapted to the expected range of application by varying the composition. For example, in case the cavity structure is a meandering type or tube-like structure, it can also be possible to replace the gel, i.e. the medium, in case of a change of use of the floor area. Further, the floor heating and cooling device can be provided as a common floor heating and cooling device, i.e., for example, in a meandering or grid-like structure of tubes with a heating and cooling medium inside that are integrated in a matrix layer. Such a layer can be arranged below the resilient layer to heat or cool the gel inside the cavity structure. The floor heating and cooling device can also be integrated within the resilient layer for better thermal contact of the heating and cooling device and the cavity structure. Depending on the temperature inertia of the material of the resilient layer, in other words, the material surrounding the floor heating and cooling device and surrounding the cavity structure, the softness of the floor construction can be changed quickly if the inertia is very small. In case it is not expected that quick changes of the degree of softness will be required, a preferred embodiment will provide a larger or higher inertia of the matrix material. This will ensure that changing the ambient temperature of the room itself, for example, by an air heating or cooling device for the room air, the floor softness is not affected. Another aspect that has to be considered is solar radiation or solar insulation entering into the room hitting the floor surface, which can lead to a warming of the floor construction itself. This is especially the case when a floor construction, according to the invention, is used in an exterior space, where direct solar insulation sometimes cannot be avoided.

To detect a current temperature of the temperature dependent rigidity material, for example, a gel, temperature sensors can be integrated into the resilient layer. By providing this information to a control unit, the floor heating and cooling device can be activated accordingly to induce the required softness of the floor area. For example, if the floor is heated by solar radiation, this can easily be detected by sensors in the upper layers of the floor or the resilient layer itself. Then the floor is cooled by the heating and cooling device, for example by circulating a cooled medium inside tubes in or at least in the vicinity of the resilient layer.

In a further preferred embodiment, the medium is a fluid and means are provided to adjust the pressure of the fluid.

The adjustment of the pressure of a fluid has the advantage that this can be conducted rather quickly compared to a change of the temperature of a gel. Whereas gel has the advantage that the means for varying the grade of resilience of the medium, i.e. the gel, can be achieved by using reliable but rather conventional technology, the adjustment of the pressure provides for a better capacity of reaction. But taking into account that a floor construction with a variable resilience may preferably be applied for floors with a rather technical use, in other words, in a rather technical environment, the more complex effort for providing a pressure adjustable cavity structure may be fully justifiable.

In a preferred embodiment, the medium is enclosed in at least one flexible tube, wherein the at least one flexible tube is arranged within the at least one container with a flexible, non-expandable envelope and wherein the at least one flexible tube is connected to the means to adjust the pressure.

Providing a flexible tube within the at least one container has the advantage that when the medium is not pressurised, in other words, when the medium is rather soft, the flexible container provides a flexible floor surface. In order to provide a stiff floor surface, the medium is pressurised and the flexible tube will expand within the container, such that the container is supported by the flexible tube and will show a decreased flexibility. In other words, the flexible container is stabilised by the pressurised medium.

In a preferred embodiment, the resilient layer comprises a flexible matrix material and the at least one container is embedded in said matrix material.

As already mentioned above, regardless of the medium, the matrix material and the container provide for a soft floor surface. In order to provide a floor surface with a rather stiff characteristic, the medium inside the at least one container is activated to provide the required stiffness.

In a preferred embodiment, the fluid is a gas and a pump device is arranged to pressurise the gas.

By providing a gas as a fluid, it is possible to change the pressure of the medium rather quickly, which leads to a rather quick change of the flexibility of the floor construction. This can be of advantage in cases where the use of the floor requires a quick change of softness. For example, during an operation in an examination room of a hospital, different operators with individual requirements concerning the floor softness may change their position in respect to the patient during the operation and hence they will stand on different areas during the procedure. Once they change their location the new floor area where they will be standing for a longer time can then be quickly adapted by providing a floor surface in that area with a required softness. Another example is the sudden need for rolling equipment across the floor to the patient on the operation table. Then, the floor resilience can quickly by changed to a stiffer surface.

For example, the gas being used can be pressurised air. This allows for an easier handling as a leakage in a system will not lead to any damage of the building construction but only a certain loss of pressurised air. A further advantage is that pressurised air is usually provided in workshops or examination rooms or laboratories anyhow. In other words, depending on the system providing pressurised air, the pump device may actually not be necessary as the pump device of the pressure air system of the building can be used. That means, in case the pressure of the pressurized air is sufficient, the pump device may be replaced with a connection to the building's internal supply and a control valve for adjusting the pressure of the gas. To decrease the pressure of the floor system, an outlet valve is provided to let off the air.

The pump is activated to increase or decrease the pressure of the fluid. In case of a building supply of pressurised air the valve is activated to increase or decrease the pressure of the fluid. Pressure detectors can detect the current pressure and give this information to a control unit to activate the pump, or valve respectively.

In another preferred embodiment, means are provided to change the temperature of the fluid to adjust the expansion of the fluid.

By adjusting the expansion of the fluid that is enclosed in a non-expandable envelope, the pressure of the fluid is changed. Preferably, the fluid will have a coefficient of thermal expansion which is adapted to the floor temperature range for the expected use. In case the coefficient is rather high, a small change of temperature is necessary only to change the expansion and thereby to change the pressure, which leads to a change in the flexibility of the floor area. For example, the fluid can be provided inside an enclosed tube-like system which does not require any maintenance. The means to change the temperature of the fluid can, for example, consist of an adapted floor heating and cooling device. Such a floor heating and cooling device can, for example, be integrated in the resilient layer to provide a better thermal contact between the heating and cooling device and the fluid itself. Depending on the thermal inertia of the material, the change can be obtained rather quickly or for a slower change a material with a larger inertia can be provided, i.e. a resilient layer with a higher inertial mass. Hence, a floor construction can be provided that will not react with a change in the degree of resilience when the room temperature is changed.

In a further embodiment, the medium comprises crystalline elements whose orientations are adjustable by altering electrical potential and where means are provided to supply electrical potential to the crystalline elements.

The change of the orientation leads to a change in the resulting resilience of the medium. The application of electrical potential has the advantage that this can be changed in a very quick way which then leads to a quick rearrangement of the orientation of the elements. As a result, the softness of the floor can be altered quickly because the flexibility of the medium itself is altered quickly by altering the electrical potential. The mode of operation is similar to the mode of operation of liquid crystal displays (LCDs).

In a further preferred embodiment, the crystalline elements are provided within a matrix material that provides as a matrix material for the resilient layer.

The matrix material provides a rather resilient characteristic, in other words, the matrix material is rather elastic itself. By changing the orientation of the crystalline elements within the matrix material the matrix material is stiffened. Thus, the resilient layer is stiffened itself, providing for a stiffer floor surface.

In a preferred embodiment a first group of resilient elements and a second group of firm elements is provided, wherein the first group and the second group are arranged in an essentially alternating distribution and wherein the elements of the first group are adapted such to be movable in relation to the elements of the second group.

By moving the elements in relation to each other it is possible to have a floor surface resting on either of one of the groups, i.e. the adapting surface would be supported by soft elements to provide a floor with a soft reliance characteristics. In case a harder floor characteristic is required, the elements will be moved such that the adapting surface is supported mainly by the harder elements.

For example, the hard and soft elements can be arranged in alternating grids. The grids can then be moved by a mechanism. Such a mechanism comprises electromagnetic or pneumatic actuators, for example. In case the elements are arranged in an alternately manner, the adapting surface rests either on the soft elements in case these are protruding from the harder elements or on the harder elements in case these project over the softer elements. Hence, the adapting surface comprises a layer material that is capable of spanning across the lower elements without preventing or diminishing the resilience characteristics of the respective supporting elements.

In a preferred embodiment the soft elements are fixed to a base of the floor construction and the firm or rigid elements are movably mounted. For providing a soft floor the rigid elements are refracted such that only the resilient elements provide the support for the adapting surface. To achieve a floor with a less resilience, the firm elements are moved such that the adapting surface is resting on the firm elements. Hence, the floor is less resilient.

It is to be noted that in another embodiment, both elements are moveable. It is of course also possible to move only the soft elements and to mount the firm elements to a fixed base construction.

In a further preferred embodiment, means are provided that change their extension in the supporting direction of the floor when supplied with electrical potential.

For example, such means are embedded within a matrix structure that provides certain flexibility itself. When the means are in their retracted position, in other words, when they are in their short extension state, the matrix material acts as a softer material. When changing the extension of the means to a longer extension the means provide stiffer sections within the matrix material which then leads to a stiffer matrix layer, in other words, to a stiffer resilient layer. Thus, it is possible to change the softness of the floor area.

For example, such means can consist of piezo-electric elements. Depending on the required range of softness, it is possible to arrange several piezo electric elements in a direction of the supporting direction of the floor.

In a further preferred embodiment, the resilient layer comprises a monolithic material with a temperature dependent rigidity and means are provided to change the temperature of the layer comprising the material with a temperature dependent rigidity.

This allows a very simple configuration of the floor, according to the invention, which is suitable in particular for rather rough operating conditions, for example, for exterior floor areas with stable outdoor temperatures. The means to change the temperature of the layer can be provided similar to common floor heating and cooling devices.

In a further preferred embodiment, an upper layer with a flooring material is adapted to the adapting surface.

The floor material will provide for other required characteristics of the floor according to the use of the floor. For example, the flooring material will be adapted such that it is easily cleanable or that it is possible to find smaller items that have been dropped on the floor, for example, smaller parts of components such as screws, in a workshop area, or needles or similar items, in operation rooms.

The object of the invention is also reached with a method for adjusting the resilience of at least a part of a floor area comprising the following steps. First, occupancy data of the floor area is received. The occupancy data is analysed and compared with stored occupancy data sets which comprise user profiles with preset floor parameters. Then one of the occupancy data sets is selected. Further, the preset floor parameters of the selected occupancy data set are transferred to a floor surface parameter control unit. Then the resilience of the floor is adjusted according to the chosen user profile.

Thus, the floor area can automatically be adapted according to the user's individual requirements and can thus serve for an optimised user's comfort. This enhances the productivity and contentment for the staff using the room.

In a preferred embodiment, the occupancy data for the floor area can be provided by a booking schedule for an operation room or a workshop area. Such specialised rooms with advanced and complex technical equipment are usually provided for a number of staff members or staff teams. For an optimised exploitation, i.e. for an optimised use of the rather expensive equipment, the rooms are booked in advance. As the booking data usually includes information about the staff members who will use the room and thus the floor area, it is possible to set the floor softness depending on the user and expected activity procedure steps.

In another preferred embodiment, the setting of the floor softness can be coupled with other so-called ambient experience systems.

This complements other settings like personalised lighting and audio that can also be set per user or per procedure step connected with the occupancy data input when booking such a specialised floor area.

For example, a method is provided for adjusting the resilience of at least a part of the upper surface in an examination room in a hospital with the following steps. The occupancy data for the examination room is received. The occupancy data is then analysed and compared with stored operator data sets, which have been input in a storage unit connected to a control unit. Then one of the store operator data sets is determined and said operator data set comprises at least one user profile. The user profile of the determined operator data set is then transferred to a floor surface parameter control unit. When the examination room is used, which can automatically be detected, the floor surface parameters are adjusted according to the chosen user profile.

In another preferred embodiment a so-called fixotrop material is combined to allow for a softer surface for slower impacts, or slower movements, such as a person standing on the floor. For faster impacts, i.e. faster movements, such as a person walking or equipment rolling across the floor, the material will appear stiffer. The fixotrop material can be applied in an additional layer on top of the adapting surface or integrated in smaller cavities located near the upper surface of the resilient layer.

A fixotrop characteristic can also be applied to the medium for altering the grade of resilience.

It is to be noted that the floor construction according to the invention can be used both for new building projects and refurbishment purposes.

These and other aspects of the invention will be apparent from the exemplary embodiments described hereinafter with reference to the drawings.

DETAILED DESCRIPTION OF EMBODIMENTS

Figure 1:
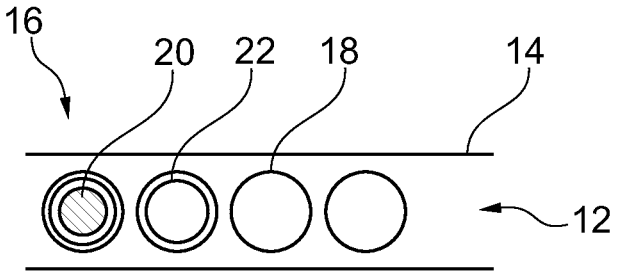
FIG. 1 schematically shows a section through a floor construction in a first exemplary embodiment.

FIG. 1 schematically shows a section through a floor construction with a resilient layer 12 with a variable resilience and an adapting surface 14. Further, means 16 are provided for varying the grades of resilience. Therefore, in FIG. 1 the resilient layer 12 comprises a cavity structure with a number of cavities 18.

The cavities 18 are filled with a medium 20 with a variable flexibility. The flexibility of the medium 20 can be modified by means which are not shown in FIG. 1 but which are described further below in relation with other embodiments. In FIG. 1 the medium 20 with a variable flexibility is enclosed in a number of containers 22 with a flexible, non-expandable envelope.

By providing the medium inside such a container 22 the container itself can either act as a flexible element in case the medium is modified to be flexible itself. To provide certain stiffness, the medium 20 is modified to be stiff or at least harder than in the state when it is flexible, the container 22 is then supported by the medium 20. Thus, the container acts as a stiffening element inside the cavities and stabilizing the resilient layer 12.

The resilient layer may be of a flexible matrix material. This means that without providing any additional stiffening elements, the resilient layer 12 is flexible which leads to a soft surface 14.

In order to provide a layer with a rather stiff or hard surface 14, the medium 20 inside the cavities 18 is modified to be stiff so that the resilient layer 12 is supported in the direction of the supporting direction of the floor surface, in other words, the medium 20 provides for a stiffness in the direction of load gravity acting on the floor.

Figure 2:
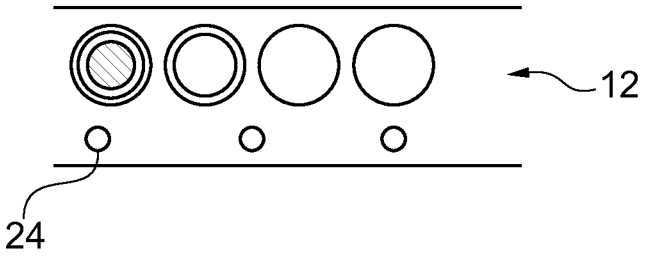
FIG. 2 shows another exemplary embodiment of a floor construction, according to the invention.

In FIG. 2 the medium 20 comprises a material with a temperature dependent rigidity. To modify the flexibility of the medium 20 means 24 are provided to change the temperature of the medium. In the example shown in FIG. 2 (in a section through the floor construction) the means 24 comprise a floor heating and cooling device in form of tubes, or a tubular structure, embedded within the material of the resilient layer 12. For example, the material with a temperature dependent rigidity is a gel. The gel can be adapted to the expected use of the floor surface in respect of the temperatures where the room with the floor area is used. For example, if the room is a workshop where temperatures are rather low compared to, for example, office rooms, the temperature dependent rigidity of the gel is set to these operating temperatures. Whereas, for example, if the room is an operation room in a hospital, where temperatures are, for example, above 20° C., the rigidity of the gel is set to these temperatures.

Figure 3:
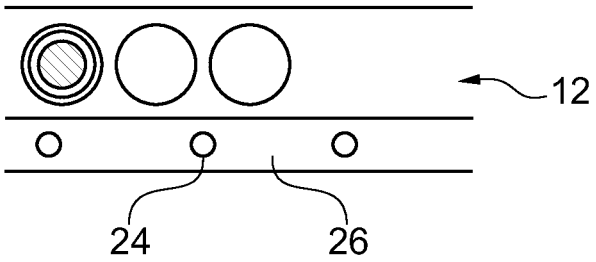
FIG. 3 shows a further exemplary embodiment.

FIG. 3 shows a section through another exemplary embodiment of the invention where the floor heating and cooling device 24 is integrated in a separate layer 26 which is arranged below the resilient layer 12. With the floor heating and cooling device 24 it is possible to heat or cool the resilient layer and therewith to cool and heat the medium 20 inside the containers 22 located in the cavities 18. Hence, by changing the temperature with the heating and cooling device 24 the flexibility of the medium is changed according to the desired stiffness of the resilient layer 12.

Figure 4:
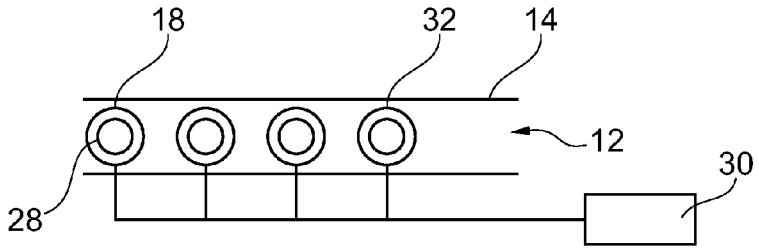
FIG. 4 shows another exemplary embodiment.

In another exemplary embodiment of the invention shown in FIG. 4, the medium is a fluid. The medium is enclosed in flexible tubes 28 that are arranged in the cavities 18 of the resilient layer 12. The flexible tubes 28 are connected to a pumping device 30 to adjust the pressure of the fluid inside the tubes. For example, the flexible tubes 28 are arranged within a container 32 with a flexible, non-expandable envelope, which container is arranged in the cavities 18.

The resilient layer 12 comprises a flexible matrix material. As the containers 32 are flexible too, the resilient layer provides a soft surface 14. In order to provide a harder surface 14 the pressure device, i.e. the pumping device 30, is activated to increase the pressure of the fluid inside the flexible tubes. Thus, the flexible tubes act as a stiffening element supporting the envelope of the container 32. Due to the supporting effect of the stiff flexible tubes 28, the container 32 itself acts as a supporting element within the resilient layer 12 leading to a resilient layer with a rather stiff characteristic. Thus, the floor surface 14 is not soft anymore but a hard surface.

For example, the fluid inside the flexible tubes 28 is a gas. Preferably the gas is compressed air, which is commonly available in technical building environments anyhow. In such cases where pressurised air is sufficiently available instead of the pumping device 30 a connection to the internal compressed air supply of the building is provided. A control valve is provided to adjust the pressure of the air inside the tubes 28.

In a further example the containers with the tubes are arranged next to each other. A cover is provided on top of the containers to provide for a fixation of the containers. A matrix material is not provided to allow a very light and thin floor construction.

Instead of a pumping device it is also possible to provide means to change the temperature of the fluid inside the tubes. By changing the temperature of the fluid the expansion of the fluid can be adjusted. Hence, depending on the non-expandable envelope surrounding the tubes, the pressure of the fluid can be adjusted too. For example, a heating and cooling device for heating or cooling the resilient layer can be arranged in the vicinity of the tubes containing the fluid. This can either be done by integrating the heating and cooling device into the resilient layer 12 or by arranging such a cooling and heating device below the resilient layer.

Figure 5:
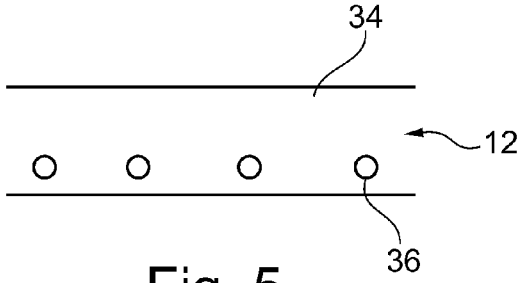
FIG. 5 shows another exemplary embodiment of the invention.

In a further exemplary embodiment, according to the invention shown in FIG. 5, the resilient layer 12 comprises a monolithic material 34 with a temperature dependent rigidity. Further, means 36 are provided to change the temperature of the layer comprising the material with a temperature dependent rigidity. For example, the means 36 to change the temperature are integrated into the resilient layer. But of course, it is also possible to locate the means 36 to change the temperature underneath the resilient layer 12. The monolithic material 34 is suitable in particular in rather rough environments, such as outdoor areas. The means 36 to change the temperature can comprise a commonly known cooling and heating device that is used in floor constructions.

Figure 6A:
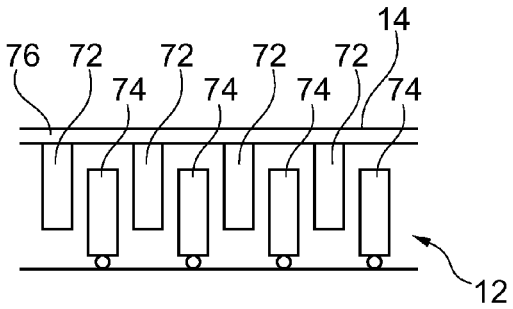
FIG. 6 shows another exemplary embodiment of the invention.
Figure 6B:
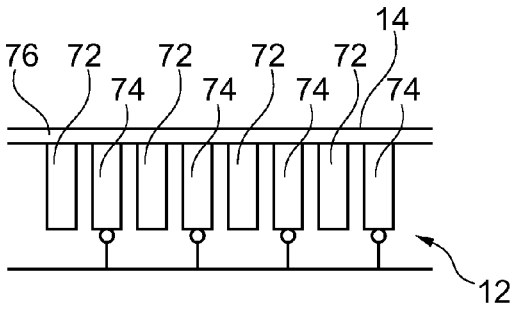

In the exemplary embodiment shown in FIGS. 6*a* and 6*b*, a first group of resilient elements 72 and a second group of firm elements 74 is provided. The resilient elements 72 of the first group and the second group are distributed in an alternating fashion as can be seen in the section in FIG. 6. For example, the elements can have a long linear shape extending across the room or they can be arranged in a gridlike manner having smaller shapes each. To provide a floor with an adjustable resilience the elements 72 of the first group are movable in relation to the elements 74 of the second group.

In the embodiment shown, the resilient elements 72 are fixed to a lower base layer. The firm elements 74 can be moved up and down, preferably in a synchronous movement, by a not shown mechanism. The mechanism comprises actuators to provide the movement, for example electromagnetic or electro-hydraulic actuators. The adapting surface 14 is provided as a layer 76 capable of spanning across the distance between each of the group elements.

In FIG. 6*a* the adapting surface rests on the soft or resilient elements 72. Hence, the floor is having a resilient characteristic. In case of very heavy loads, the firm elements provide a stop position such that the softer elements are not compressed too far.

In FIG. 6*b* the firm elements are moved upwards such that the adapting surface 14 with its spanning layer 76 rests on both the soft elements 72 and the firm elements 74. Due to the spanning effect of the spanning layer 76, the softer elements 72 will have no influence on the floor's resilience since the firm elements 74 provide for the (only effective) supportiveness.

Figure 7A:
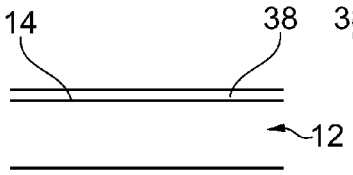
FIG. 7 schematically shows exemplary embodiments of a resilient layer with different floor surface layers.

The adapting surface 14 is provided with a flooring material 38 adapted to the adapting surface 14. For example, as shown in FIG. 7*a*, the flooring material 38 is a PVC flooring connected to the adapting surface 14 by an adhesive layer. Of course, the flooring material 38 has to fulfil the required specifications depending on the use of the floor construction.

Figure 7B:
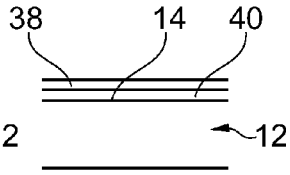

In another example shown in FIG. 7*b* an intermediate layer 40 is arranged between the adapting surface 14 and the flooring material 38. The intermediate layer 40 can be arranged such that the resilient characteristic of the resilient layer 12 is enhanced or decreased depending on the requirements and the chosen construction of the resilient layer 12. For example, if the resilient layer is not soft enough when the resilient layer is having a stiff resilient characteristic, the additional layer 40 can provide a minimum of a soft characteristic of the floor surface.

However, the materials and layers respectively arranged on top of the resilient layer, i.e. all layers arranged on the adapting surface 14, show certain flexibility in order not to prevent or damp the flexibility or softness of the resilient layer 12 located underneath.

Figure 7C:
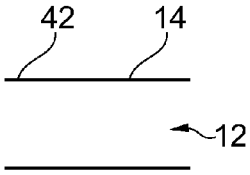

In a further exemplary embodiment shown in FIG. 7*c*, the adapting surface 14 is provided with a coating 42 only that serves as a protection layer for the resilient layer 12.

Of course, it is also possible to provide additional layers on top of the resilient layer 12.

Figure 8:
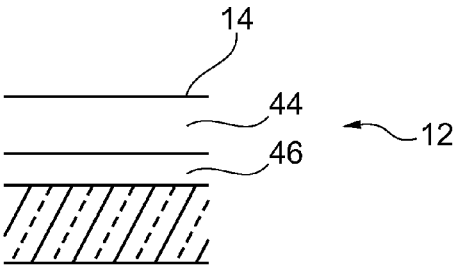
FIG. 8 shows another exemplary embodiment of a floor with adjustable resilience with at least two layers.

For an enhanced adaptability of the floor softness, in an exemplary embodiment shown in FIG. 8 the resilient layer comprises two resilient layers 44, 46 wherein the two layers are laid upon each other. For example, the upper resilient layer 44 can be used for adapting the softness of the floor surface. The lower resilient layer 46 can be used, for example, for adapting the flexibility of the floor construction as this is known from static so-called impact sound insulation layers arranged underneath a stiff floor construction for damping the sound resulting from direct impacts on to the floor surface. In other words, besides the softness that can be felt on the actual surface of the floor it is thereby possible to provide a damping effect on the floor which can provide a relief to staff members moving, i.e. walking, across the floor surface.

Figure 9C:
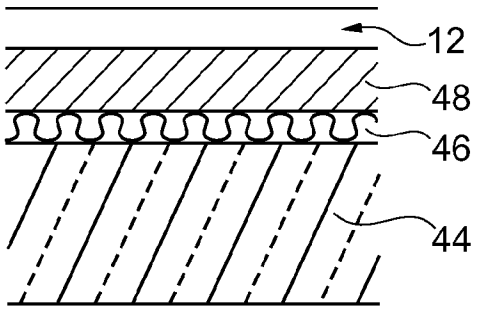
FIG. 9 shows exemplary embodiments of the resilient layer in relation with a supporting structure of the building.
Figure 9B:
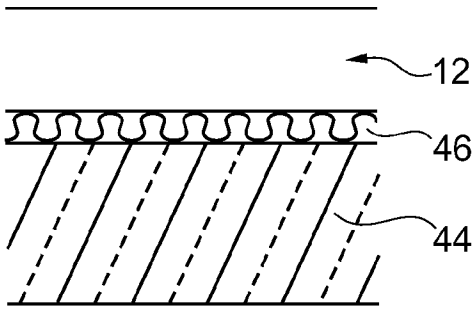
Figure 9A:
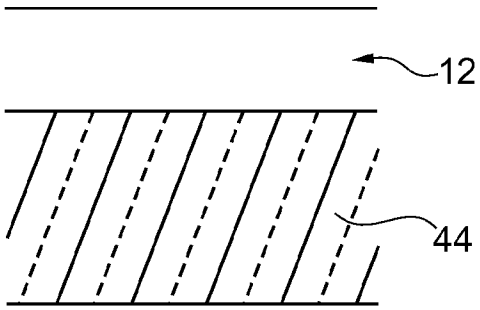

In FIGS. 9*a*, 9*b* and 9*c*, three examples are shown how the resilient layer can be supported. In a first example the resilient layer 12 is located on top of a supporting layer 42, for example, a concrete base plate or ceiling panel within a multi-storey building (FIG. 9*a*). Of course, it is also possible to arrange an intermediate layer 46 between the resilient layer 12 and the supporting layer 44, for example, an acoustic insulation layer provided to damp acoustic impact resulting from direct impacts on the floor surface. Such an insulation layer 46 can also provide a certain thermal insulation as well (FIG. 9*b*). In case of a rather thin resilient layer 12 or in case of a rather low supporting ability of the layer 12, i.e. in case the layer 12 is rather soft when the supporting means integrated into the resilient layer are not activated, an additional supporting intermediate layer 48 can be provided below the resilient layer 12. The additional intermediate supporting layer 48 serves as a supporting layer distributing the load forces to the insulation layer 46 underneath which is usually not capable of carrying rather point shaped impact loads but only distributed loads. The insulation layer 46 is arranged on top of a supporting layer 44, i.e. on top of the floor or ceiling panel as mentioned in relation with FIGS. 9*a* and 9*b* (FIG. 9*c*).

Figure 10:
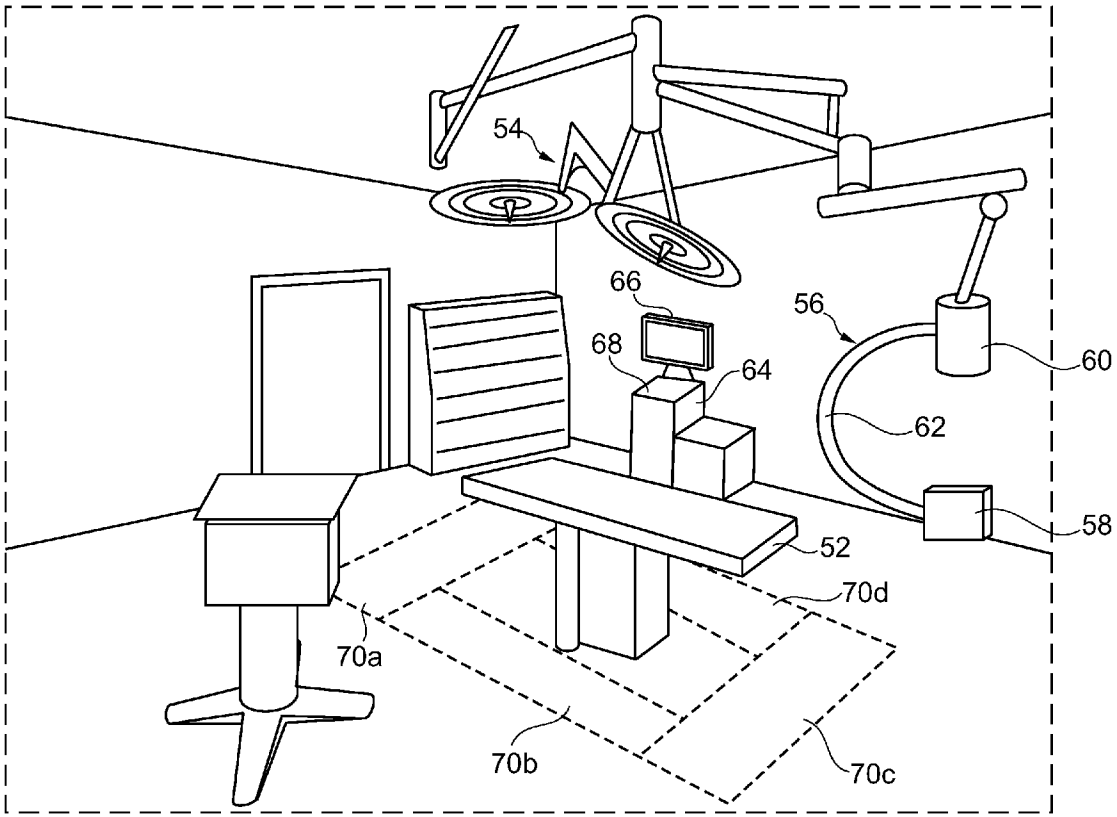
FIG. 10 shows a floor area of a room with a number of different sections.

In FIG. 10 an operation room in a hospital is schematically shown in a perspective view. An operation table 52 to receive a subject to be examined is provided in the centre of the room. An adjustable lighting means 54 with a number of lighting devices is arranged below the ceiling above the operation table 52. On one side of the operation table, in FIG. 10 on the right side behind the table, an X-ray imaging system 56 is provided. The X-ray imaging system 56 comprises an X-ray image acquisition device with a source of X-ray radiation 58 provided to generate X-ray radiation. Further, an X-ray image detection module 60 is located opposite the source of X-ray radiation 58. The X-ray image acquisition device comprises an arm 62 in form of a C where the image detection module 60 is arranged at one end of the C-arm and the source of X-ray radiation 58 is located at the opposite end of the C-arm. The C-arm is moveably mounted and can be moved towards the table 52 where it can be rotated around the object of interest located on the table 52. That means during the radiation procedure the subject is located between the source of X-ray radiation 58 and the detection module 60. The latter is sending data to a data processing unit or calculation unit 64, which is connected to both the detection module 60 and the radiation source 58. Further, a display device 66 is arranged in the vicinity of the table 52 to display information to the person operating the X-ray imaging system, which can be a clinician such as a cardiologist or cardiac surgeon. Preferably, the display device 66 is moveably mounted to allow for an individual adjustment depending on the examination situation. Also, an interface unit 68 is arranged to input information by the user.

The floor in the middle of the room around the operation table 52 is the area where staff members are expected to stay for a longer period during the operation procedure. Usually different members are arranged around the different sides of the table 52. To allow an individual adjustment of the floor softness, according to one exemplary embodiment of the invention, the floor area is divided into segments 70*a*, 70*b*, 70*c*, 70*d*. The softness of the floor segments 70 can be controlled independently according to the individual requirements by a control unit that is integrated into the calculation unit 64 of the imaging device. Here, occupancy data for the room can be supplied by a central data processing unit of the hospital. The occupancy data comprises information about when and how the room is used and the data of staff members expected for the use. The occupancy data is analyzed and compared by the calculation unit 64 with stored occupancy data sets which comprise user profiles with preset floor parameters. Then one of the occupancy data sets is selected and the preset floor parameters of the selected occupancy data set are transferred to a floor surface parameter control unit in the calculation unit 64. Then, the resilience of the floor is adjusted according to the chosen user profiles.

In case the staff change their place during the operation it is possible to adjust the softness for this situation by automatically detecting the change with a sensor device (not shown) or by entering a command by the interface 68.

When heavy equipment has to be moved during the operation, for example in case of a moveable C-arm X.ray device, the floor's softness is adjusted to be rather stiff to allow for an easier rolling across the floor surface. For further procedures the floor's softness can be individually adjusted to be soft again in designated zones or parts.

While the invention has been illustrated and described in detail in the drawings and foregoing description, such illustration and description are to be considered illustrative or exemplary and not restrictive; the invention is not limited to the disclosed embodiments. It is to be noted that features described in relation to the above discussed embodiments can also be used with other features of other above described exemplary embodiments.

The invention claimed is:

1. A floor construction, comprising:

a resilient layer with a variable resilience that has a grade and an adapting surface; and means for varying the grade of resilience.

2. The floor construction according to claim 1, wherein the resilient layer comprises an embedded cavity structure with at least one cavity; wherein the at least one cavity is filled with a medium with a variable flexibility; and wherein means are provided for modifying the flexibility of said medium.

3. The floor according to claim 2, wherein the medium with a variable flexibility is enclosed in at least one container with a flexible, non-expandable envelope.

4. The floor according to claim 3, wherein the medium comprises a material with a temperature-dependent rigidity; and wherein means are provided to change the temperature of the medium.

5. The floor according to claim 4, wherein the material with a temperature-dependent rigidity is a gel; and wherein a floor heating and cooling device is provided.

6. The floor construction according to claim 2, wherein the medium is a fluid; and wherein means are provided to adjust the pressure of the fluid.

7. The floor construction according to claim 6, wherein the medium is enclosed in at least one flexible tube; wherein the at least one flexible tube is arranged within at least one container with a flexible, non-expandable envelope; and wherein the at least one flexible tube is connected to the means to adjust the pressure.

8. The floor construction according to claim 7, wherein the resilient layer comprises a flexible matrix material; and wherein the at least one container is embedded in said matrix material.

9. The floor construction according to claim 6, wherein the fluid is a gas; and wherein a pump device is arranged to pressurize the gas.

10. The floor construction according to claim 6, wherein means are provided to change the temperature of the fluid to adjust the expansion of the fluid.

11. The floor construction according to claim 1, wherein a first group of resilient elements and a second group of firm elements is provided; wherein the first group and the second group are arranged in an essentially alternating distribution; and wherein the elements of the first group are configured such as to be movable in relation to the elements of the second group.

12. The construction floor according to claim 1, wherein means with a variable extension in the supporting direction of the floor are provided; and wherein the means change their extension when supplied with electrical potential.

13. The floor construction according to claim 1, wherein the resilient layer comprises a monolithic material with a temperature-dependent rigidity; and wherein means are provided to change the temperature of the layer comprising the material with a temperature-dependent rigidity.

14. The floor construction according to claim 1, wherein an upper layer with a flooring material is adapted to the adapting surface.

15. A method for automatically adjusting the resilience of at least a part of a floor area comprising the steps of:

receiving occupancy data for the floor area;

analyzing and comparing the occupancy data with stored occupancy data sets which comprise user profiles with preset floor parameters;

selecting one of the occupancy data sets;

transferring the preset floor parameters of the selected occupancy data set to a floor surface parameter control unit; and adjusting the resilience of the floor according to the chosen user profile.

16. A floor construction, comprising:

a resilient layer with a variable resilience and an adapting surface, said resilient layer comprising a cavity structure having at least one cavity that is filled with a medium of variable flexibility, said medium being enclosed in at least one container having a flexible, non-expandable envelope.

17. The floor construction of claim 16, said medium comprising a material with a temperature-dependent rigidity.

18. The floor construction of claim 17, wherein the material with a temperature-dependent rigidity is a gel.

19. The floor construction of claim 18, further comprising, as a floor heating and cooling device, tubes containing a heating and cooling medium.

20. The floor construction of claim 16, said at least one cavity amounting to a plurality of cavities, said at least one container amounting to multiple containers.

21. The floor construction of claim 16, providing a floor surface with an adjustable softness.

22. The floor construction of claim 21, the resilient layer comprising a flexible matrix material, the at least one container being embedded in said matrix material.

* * * * *